US010276916B2

(12) United States Patent
Hasaba et al.

(10) Patent No.: US 10,276,916 B2
(45) Date of Patent: Apr. 30, 2019

(54) ANTENNA DEVICE

(71) Applicant: PANASONIC INTELLECTUAL PROPERTY MANAGEMENT CO., LTD., Osaka (JP)

(72) Inventors: Ryosuke Hasaba, Kanagawa (JP); Yuki Tanaka, Tokyo (JP); Yoshio Koyanagi, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 26 days.

(21) Appl. No.: 15/815,184

(22) Filed: Nov. 16, 2017

(65) Prior Publication Data

US 2018/0175479 A1 Jun. 21, 2018

(30) Foreign Application Priority Data

Dec. 19, 2016 (JP) ..... 2016-245400
May 31, 2017 (JP) ..... 2017-107966

(51) Int. Cl.
*H01Q 1/22* (2006.01)
*H01Q 9/04* (2006.01)
(Continued)

(52) U.S. Cl.
CPC ..... *H01Q 1/2225* (2013.01); *H01Q 1/48* (2013.01); *H01Q 5/378* (2015.01);
(Continued)

(58) Field of Classification Search
CPC ..... H01Q 1/2225; H01Q 1/48; H01Q 9/0421; H01Q 9/0428; H01Q 9/0407; H01Q 19/005
See application file for complete search history.

(56) References Cited

U.S. PATENT DOCUMENTS 5,420,599 A * 5/1995 Erkocevic ..... H01Q 1/243 343/702
6,295,030 B1 * 9/2001 Kozakai ..... H01Q 1/243 343/700 MS (Continued)

FOREIGN PATENT DOCUMENTS

JP 2005-079970 A 3/2005
JP 5636930 B2 10/2014

*Primary Examiner* — Dameon E Levi
*Assistant Examiner* — Ab Salam Alkassim, Jr.
(74) *Attorney, Agent, or Firm* — Greenblum & Bernstein, P.L.C.

(57) ABSTRACT

An antenna device includes a first plate conductor that is disposed approximately in parallel to the GND conductor plate, of which one end is connected to the GND conductor plate, and the other end that is opposed to the one end is opened, and a second plate conductor that has approximately the same shape as that of the first plate conductor, of which one end is grounded to the GND conductor plate, of which the other end that is opposed to the one end is opened, that is disposed at a position obtained by rotating the first plate conductor approximately 180 degrees about an intersection line passing through an approximately central point of the GND conductor plate as an axis on the same plane as the first plate conductor on the GND conductor plate, and that has a ground portion at which the grounding is performed and an open portion at which the opening is performed at positions obtained by rotating the ground portion and the open portion of the first plate conductor approximately 180 degrees about the axis.

4 Claims, 10 Drawing Sheets

(51) Int. Cl.
*H01Q 1/48* (2006.01)
*H01Q 5/378* (2015.01)
*H01Q 19/00* (2006.01)

(52) U.S. Cl.
CPC ..... *H01Q 9/0407* (2013.01); *H01Q 9/0421* (2013.01); *H01Q 9/0428* (2013.01); *H01Q 19/005* (2013.01)

(56) References Cited

U.S. PATENT DOCUMENTS 6,456,243 B1 * 9/2002 Poilasne ..... H01Q 1/38 343/700 MS
6,549,169 B1 * 4/2003 Matsuyoshi ..... H01Q 1/243 343/702
6,567,053 B1 * 5/2003 Yablonovitch ..... H01Q 13/12 343/700 MS
6,768,460 B2 * 7/2004 Hoashi ..... H01Q 1/2275 343/700 MS
6,943,730 B2 * 9/2005 Poilasne ..... H01Q 1/241 343/700 MS
7,012,568 B2 * 3/2006 Desclos ..... H01Q 1/38 343/700 MS
7,193,571 B2 * 3/2007 Inatsugu ..... H01Q 1/325 343/702
7,342,552 B2 * 3/2008 Harano ..... H01Q 1/243 343/700 MS
8,994,604 B2 * 3/2015 Puente Baliarda ..... H01Q 1/36 343/803
2003/0201942 A1 * 10/2003 Poilasne ..... H01Q 1/241 343/702
2004/0212545 A1 * 10/2004 Li ..... H01Q 9/30 343/866
2005/0057401 A1 * 3/2005 Yuanzhu ..... H01Q 9/0421 343/700 MS
2008/0018548 A1 * 1/2008 Maeda ..... H01Q 1/521 343/795
2009/0079654 A1 * 3/2009 Higaki ..... H01Q 9/28 343/795
2012/0146854 A1 * 6/2012 Ishikawa ..... H01Q 21/24 343/700 MS
2012/0154237 A1 * 6/2012 Ying ..... H01Q 1/48 343/833
2012/0169562 A1 * 7/2012 Nysen ..... H01Q 9/0414 343/843
2016/0380340 A1 * 12/2016 Inoue ..... H01Q 9/0407 343/702
2018/0342784 A1 * 11/2018 Samardzija ..... H01Q 1/02

* cited by examiner

ANTENNA DEVICE

BACKGROUND

1. Technical Field

The present disclosure relates to a preferable antenna device used in a small communication terminal such as a tag of a radio frequency identifier (RFID).

2. Description of the Related Art

An RFID is an automatic recognition system that reads and writes individual information stored in a tag in a non-contact manner by using radio wave.

Reading and writing of an RFID tag of the individual information are performed by a reader and writer.

The tag of the RFID is referred to as various names such as the RFID tag, an IC tag, and a wireless tag, but the tag will be referred to as the RFID tag in the present specification.

In general, since the RFID tag radiates a linear polarized wave, a circularly polarized wave is used for the reader and writer in order to increase tolerance depending on a position of the RFID tag.

However, in a case where the circularly polarized wave is also used for an RFID tag side when the RFID tag and the reader and writer are opposed to each other, there is no polarization matching loss such that it is advantageous in a communication distance and a received electric power.

For example, as the antenna device that is used in the RFID tag, there are ones described in Japanese Patent No. 5636930 and Japanese Patent Unexamined Publication No. 2005-079970.

An antenna device described in Japanese Patent No. 5636930 includes a ground plate, two radiation conductor parts, each of two radiation conductor parts includes a feed part insulated and formed on the ground plate, a shorting part connected to the ground plate, and a conductor section which is connected to the feed part and the shorting part, in parallel with the ground plate, and separated and extended with a predetermined interval from the ground plate, and a feeder circuit that supplies electric power to the two radiation conductor parts with an opposite phase, in which the two radiation conductor parts are arranged in a point symmetry with respect to the ground plate by a center point of the ground plate as a point symmetry.

The antenna device described in Japanese Patent Unexamined Publication No. 2005-079970 includes a first radiation conductor plate opposite to a ground conductor plane approximately in parallel with each other, a second radiation conductor plate adjacent to the first radiation conductor plate by being disposed so as to be opposed approximately in parallel to the ground conductor plane via a slit (gap), a feeding conductor plate connected to a feeding circuit by extending approximately at a right angle from an outer edge not opposite to the slit of the first radiation conductor plate, a first short-circuit conductor plate connected to the ground conductor plan by extending approximately at the right angle from the outer edge not opposite to the slit of the first radiation conductor plate, and a second short-circuit conductor plate connected to the ground conductor plan by extending approximately at the right angle from the outer edge not opposite to the slit of the second radiation conductor plate, in which the first and second radiation conductor plates are brought close to each other in an approximately line symmetric positional relationship with the slit as a symmetry axis.

SUMMARY

As described above, in a case where an RFID tag and a reader and writer are opposed to each other, it is advantageous in a communication distance and a reception electric power when a circularly polarized wave is also used for an RFID tag side.

However, there is a problem that it is difficult to implement a highly sensitive and a small antenna device having circular polarization characteristics.

An object of the present disclosure is to provide an antenna device which has circular polarization characteristics and high sensitivity in which miniaturization which can be used for small communication terminals such as RFID tags is achieved, and which is easily created.

The antenna device of the present disclosure includes a flat plate GND conductor plate; a first plate conductor that is disposed approximately in parallel to the GND conductor plate, and of which one end is grounded to the GND conductor plate, and the other end that is opposed to the one end is opened; and a second plate conductor that has approximately the same shape as that of the first plate conductor, of which one end is grounded to the GND conductor plate, of which the other end that is opposed to the one end is opened, that is disposed at a position obtained by rotating the first plate conductor approximately 180 degrees about an intersection line passing through an approximately central point of the GND conductor plate as an axis on the same plane as the first plate conductor on the GND conductor plate, and that has a ground portion at which the grounding is performed and an open portion at which the opening is performed at positions obtained by rotating the ground portion and the open portion of the first plate conductor approximately 180 degrees about the axis, in which the first plate conductor and the second plate conductor have a gap with approximately equal intervals between sides adjacent to each other, the gap is formed by a side other than the one end and the other end on a surface of the first plate conductor approximately in parallel to the GND conductor plate and a side other than the one end and the other end on a surface of the second plate conductor approximately in parallel to the GND conductor plate, a series of lengths from the other end that is an open end of the first plate conductor to the other end that is an open end of the second plate conductor, through the one end of the first plate conductor that is grounded, a position on the GND conductor plate on which the first plate conductor is grounded, a position on the GND conductor plate on which the second plate conductor is grounded, and the one end of the second plate conductor that is grounded, are almost equal to an electric length of approximately ½ wavelength of a frequency to be used, electric power is supplied from any one of the first plate conductor and the second plate conductor, and circularly polarized wave is radiated from a surface of the GND conductor plate not including the first plate conductor and the second plate conductor to a surface of the GND conductor plate including the first plate conductor and the second plate conductor.

According to the configuration, a configuration is adopted in which the first plate conductor is disposed approximately in parallel to the GND conductor plate, the second plate conductor formed with approximately the same shape as that of the first plate conductor is disposed approximately in parallel to the GND conductor plate while providing a gap with approximately equal intervals between sides adjacent to the first plate conductor, in the first plate conductor, of which one end is short-circuited to the GND conductor plate, of which the other end is opened, and in the second plate conductor of which one end of a side opposite to the first plate conductor is short-circuited and the other end is opened. Power supplying is performed from one of the first plate conductor and the second plate conductor, and the gap is formed by a side other than the one end and the other end on a surface of the first plate conductor approximately in parallel to the GND conductor plate and a side other than the one end and the other end on a surface of the second plate conductor approximately in parallel to the GND conductor plate.

Furthermore, in the first plate conductor and the second plate conductor, a series of physical lengths from the other end that is an open end of the first plate conductor to the other end that is an open end of the second plate conductor, through the one end of the first plate conductor that is grounded, a position on the GND conductor plate on which the first plate conductor is grounded, a position on the GND conductor plate on which the second plate conductor is grounded, and the one end of the second plate conductor that is grounded, are almost equal to an electric length of the approximately ½ wavelength of a frequency to be used.

In such a configuration, for example, when power supplying is performed in the vicinity of the short-circuited end of the second plate conductor, a current flows from the power supplying point toward an open end side on the second plate conductor, reaches an open end of the second plate conductor, and flows toward a short-circuited end side of the second plate conductor on the GND conductor plate, and when reaching the short-circuited end of the second plate conductor, the current flows from an open end to a short-circuited end side on the first plate conductor.

As described above, in a case where the electric power is supplied from the vicinity of the short-circuited end of the second plate conductor, the current flows through three paths of a current path on the second plate conductor->a current path on the GND conductor plate->a current path on the first plate conductor.

Since a series of physical lengths in the first plate conductor and the second plate conductor are almost equal to the electric length of the approximately ½ wavelength of the frequency to be used, it is possible to use an antenna of circularly polarized wave characteristics of the approximately ½ wavelength.

In addition, by implementing the antenna of approximately ½ wavelength, high sensitivity is achieved.

In addition, by arranging the first and second plate conductors on the same surface, it is possible to achieve miniaturization which can also be used in small communication terminals such as the RFID tag.

In addition, since it is a simple configuration of the GND conductor plate, and the first and second plate conductor, it is possible to easily create the antenna.

As an aspect of the antenna device of the present disclosure, for example, a distance from the ground portion of the first plate conductor to an edge of the GND conductor plate near the ground portion of the first plate conductor and a distance from the ground portion of the second plate conductor that is positioned at a rotationally symmetric position by the axis with respect to the ground portion of the first plate conductor to the edge of the GND conductor plate near the ground portion of the second plate conductor are almost equal to each other.

According to the configuration, it is possible to efficiently radiate the circularly polarized wave.

As an aspect of the antenna device of the present disclosure, for example, each of the first plate conductor and the second plate conductor has a plane shape of an approximately L shape.

According to the configuration, since physical lengths of each of the first plate conductor and the second plate conductor are short, the miniaturization is achieved.

As an aspect of the antenna device of the present disclosure, for example, each of the first plate conductor and the second plate conductor has a plane shape of an approximately rectangular shape.

According to the configuration, the circularly polarized wave characteristics are obtained and the high sensitivity is achieved.

In addition, it is possible to achieve miniaturization which can also be used in small communication terminals such as the RFID tag and it is possible to easily create the antenna device.

The antenna device of the present disclosure has the circular polarization characteristics and high sensitivity, miniaturization which can be used for the small communication terminals such as the RFID tags is achieved, and is easily created.

DETAILED DESCRIPTION

Hereinafter, a preferred embodiment of implementing the present disclosure will be described in detail with reference to the drawings.

Figure 1:
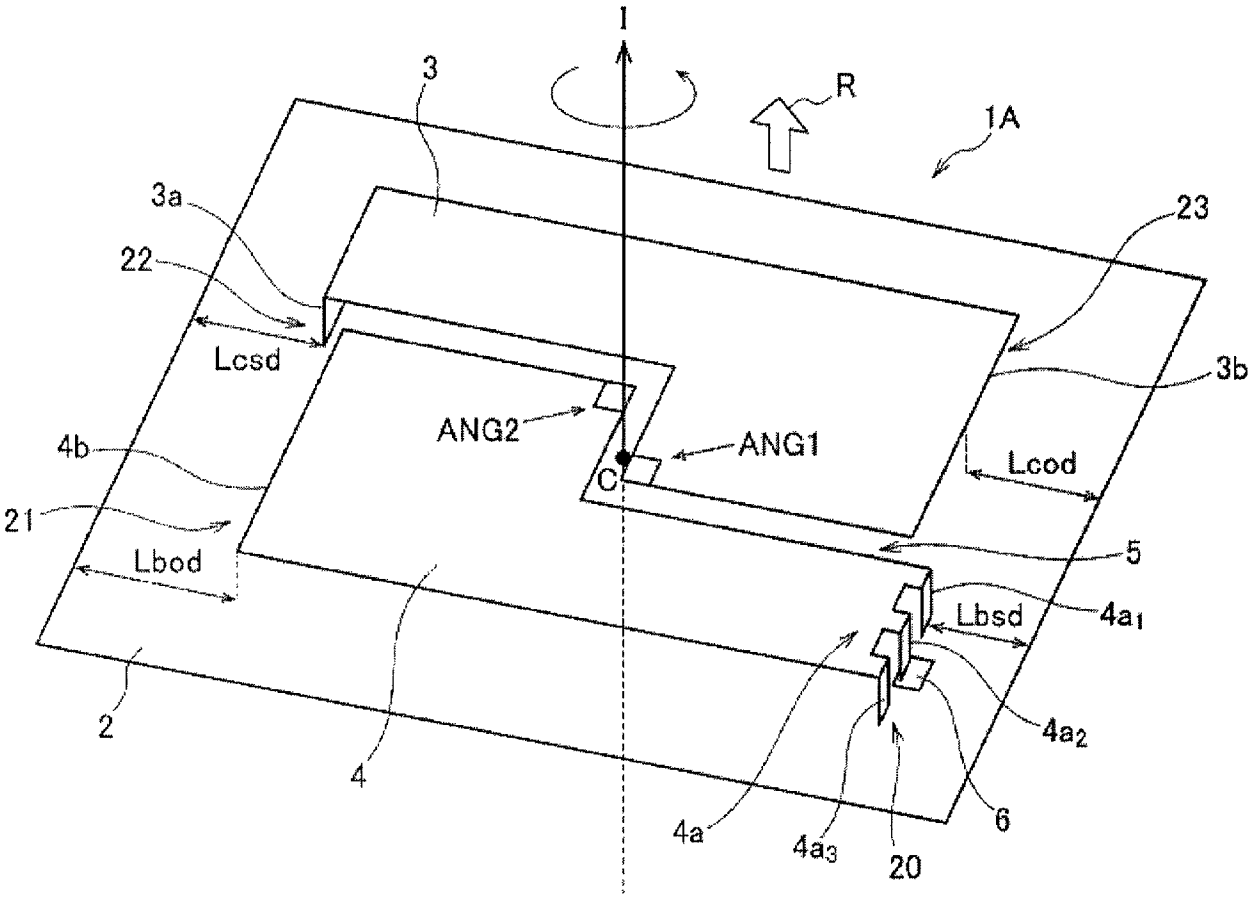
FIG. 1 is a perspective view illustrating a schematic configuration of an antenna device according to an embodiment of the present disclosure.

FIG. 1 is a perspective view illustrating a schematic configuration of antenna device 1A according to an embodiment of the present disclosure.

In the figure, antenna device 1A according to the present embodiment includes flat plate GND conductor plate 2, first plate conductor 3, and second plate conductor 4.

Each of first plate conductor 3 and second plate conductor 4 has an approximately L shape flat plate, both of which are approximately parallel to each other on GND conductor plate 2, and are arranged to be adjacent to each other while providing gap (slit) 5 with approximately equal intervals between sides adjacent to each other.

A shape and arrangement of first plate conductor 3 and second plate conductor 4 will be described in more detail.

The first plate conductor 3 is disposed in parallel to GND conductor plate 2, of which one end 3*a* is grounded to GND conductor plate 2, and of which the other end 3*b* that is opposed to one end 3*a* is opened.

A shape of second plate conductor 4 is approximately the same as that of first plate conductor 3, of which one end 4*a* is grounded to GND conductor plate 2 and connected to a power supplying point 6, of which the other end 4*b* which is opposed to one end 4*a* is opened and disposed at a position in which first plate conductor 3 rotates by approximately 180 degrees about an intersection line passing through approximately central point C of GND conductor plate 2 as axis I on the same plane as (that is, at the same height as that of first plate conductor 3) first plate conductor 3 on GND conductor plate 2, and ground portion 20 and open portion 21 are provided at positions which ground portion 22 and open portion 23 rotate by approximately 180 degrees about axis I.

One end 4*a* of second plate conductor 4 is formed with three branch portions $4a_1$ to $4a_3$, central branch portion $4a_2$ is connected to power supplying point 6 provided on GND conductor plate 2, and both branch portions $4a_1$ and $4a_3$ are short-circuited to a ground pattern (not shown) of GND conductor plate 2.

An air layer is formed between GND conductor plate 2 and first plate conductor 3 and between GND conductor plate 2 and second plate conductor 4.

A dielectric may also be implemented between GND conductor plate 2 and first plate conductor 3 and between GND conductor plate 2 and second plate conductor 4.

As described above, first plate conductor 3 and second plate conductor 4 have approximately the same shape and size, and are arranged in a mutually opposite direction.

By such an arrangement, a shape of gap 5 between first plate conductor 3 and second plate conductor 4 becomes approximately an S shape.

For example, nickel silver (alloy composed of copper, zinc, and nickel) is used in first plate conductor 3 and second plate conductor 4.

In addition, for example, the copper foil for a circuit substrate (not shown) is used in GND conductor plate 2.

A combined length of first plate conductor 3 and second plate conductor 4 is almost equal to an electric length of an approximately ½ wavelength of a frequency to be used.

Figure 2:
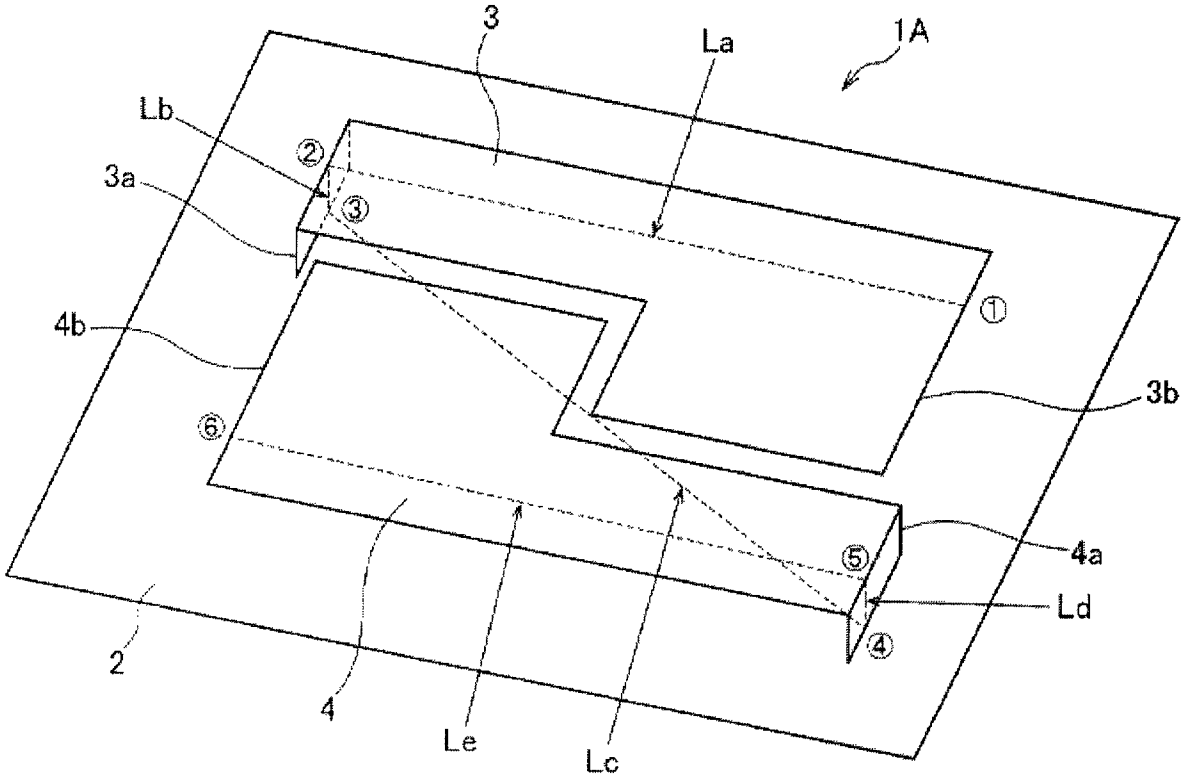
FIG. 2 is a perspective view illustrating a combined length of a first plate conductor and a second plate conductor in the antenna device in FIG. 1.

FIG. 2 is a perspective view illustrating a combined length of first plate conductor 3 and second plate conductor 4 in antenna device 1A according to the present embodiment.

As illustrated in this figure, the combined length of first plate conductor 3 and second plate conductor 4 is a series of lengths of length La from the other end 3*b* (position indicated by circled numeral 1) that is an open end of first plate conductor 3 to the apex (position indicated by circled numeral 2) of the corner of one end 3*a* of first plate conductor 3 that is grounded, length Lb from the apex (position indicated by circled numeral 2) of the corner of one end 3*a* of first plate conductor 3 to the tip end (position indicated by circled numeral 3) in contact with GND conductor plate 2 of one end 3*a* of first plate conductor 3, length Lc from the tip end (position indicated by circled numeral 3) in contact with GND conductor plate 2 of one end 3*a* of first plate conductor 3 to the tip end (position indicated by circled numeral 4) in contact with GND conductor plate 2 of one end 4*a* of second plate conductor 4, length Ld from the tip end (position indicated by circled numeral 4) in contact with GND conductor plate 2 of one end 4*a* of second plate conductor 4 to the apex (position indicated by circled numeral 5) of the corner of one end 4*a* of second plate conductor 4, and length Le from the apex (position indicated by circled numeral 5) of the corner of one end 4*a* of second plate conductor 4 to the other end 4*b* (position indicated by circled numeral 6) of second plate conductor 4.

The series of lengths is almost equal to an electric length of the approximately ½ wavelength of the frequency to be used.

That is, $La+Lb+Lc+Ld+Le \cong \lambda < 1/2$ is satisfied.

However, it is desirable that lengths La, Lc, and Le be as close as possible.

In addition, lengths Lb and Ld are implemented sufficiently smaller than lengths La, Lc, and Le.

In addition, a positional relationship between GND conductor plate 2 and first plate conductor 3 and second plate conductor 4 is as follows.

That is, as illustrated in FIG. 1, for example, distance Lcod from open portion 23 of first plate conductor 3 to an edge of GND conductor plate 2 near open portion 23 of first plate conductor 3 and distance Lbod from open portion 21 of second plate conductor 4 that is a rotationally symmetric position by axis I with respect to open portion 23 of first plate conductor 3 to an edge of GND conductor plate 2 near open portion 21 of second plate conductor 4 need to be 1/10 wavelength or more of the frequency to be used.

In addition, distance Lcsd from ground portion 22 of first plate conductor 3 to an edge of GND conductor plate 2 near ground portion 22 of first plate conductor 3 and distance Lbsd from ground portion 20 of second plate conductor 4 that is a rotationally symmetric position by axis I with respect to ground portion 22 of first plate conductor 3 to an edge of GND conductor plate 2 near ground portion 20 of second plate conductor 4 are almost equal to each other.

In addition, for example, each of distances between GND conductor plate 2 and first plate conductor 3 and between GND conductor plate 2 and second plate conductor. 4 is approximately 1/100 wavelength to 1/30 wavelength.

In addition, for example, when miniaturization of antenna device 1A of the present embodiment is considered, a width of gap 5 between first plate conductor 3 and second plate conductor 4 is approximately 1/50 wavelength.

Antenna device 1A according to the present embodiment, electric power is supplied in the vicinity of the short-circuited end (one end 4*a*) of second plate conductor 4.

That is, as illustrated in FIG. 1, the electric power is supplied in the vicinity of branch portions $4a_2$ of one end 4*a* of second plate conductor 4.

The electric power may be supplied in the vicinity of the short-circuited end (one end 3*a*) of first plate conductor 3.

By supplying the electric power from the vicinity of a short-circuited end of second plate conductor 4, circularly polarized wave is radiated in a direction orthogonal to GND conductor plate 2 from a surface (this is called as "back surface") of GND conductor plate 2 not including first plate conductor 3 and second plate conductor 4 to a surface (this is called as "front surface") of GND conductor plate 2 including first plate conductor 3 and second plate conductor 4.

That is, the circularly polarized wave is radiated in a direction indicated by arrow R in FIG. 1.

Particularly, since a positional relationship between GND conductor plate 2 and first plate conductor 3 and second plate conductor 4 is set as described above, it is possible to efficiently radiate the circularly polarized wave.

That is, for example, since distance Lcsd and distance Lbsd are almost equal to each other by setting a frequency using distance Lcod and distance Lbod to 1/10 wavelength or more, it is possible to efficiently radiate the circularly polarized wave.

Figure 3:
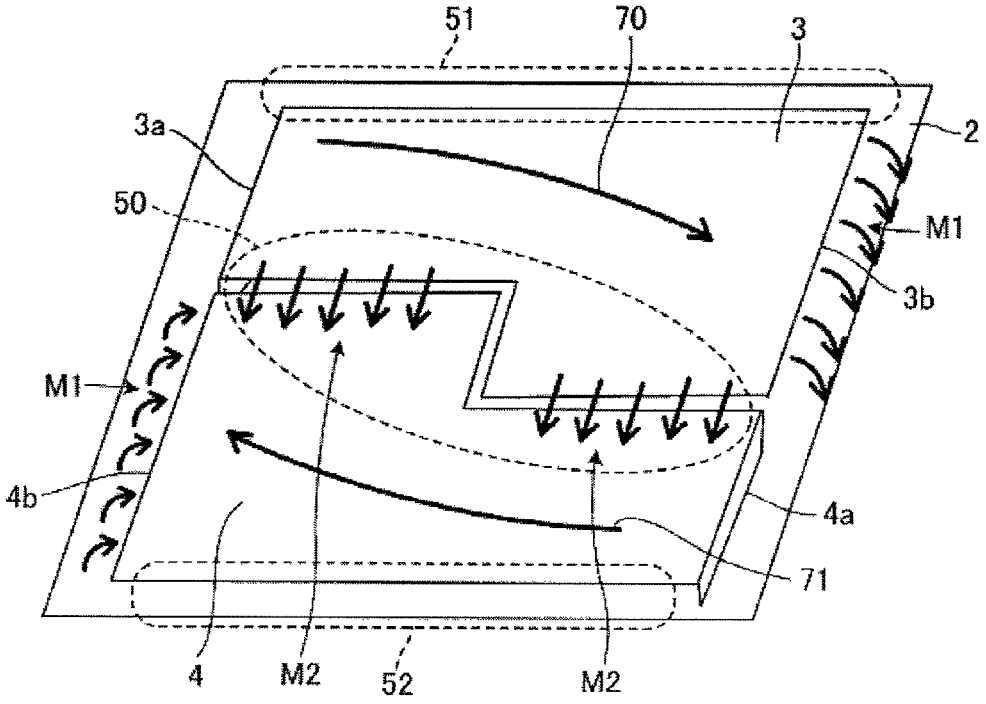
FIG. 3 is a diagram illustrating electric field distribution in the antenna device in FIG. 1.

FIG. 3 is a diagram illustrating electric field distribution in antenna device 1A according to the present embodiment.

As illustrated in this figure, when the electric power is supplied from the vicinity of the short-circuited end from second plate conductor 4, an electric field occurs from all end portions except one end 3*a* of first plate conductor 3 short-circuited to GND conductor plate 2 and from all end portions except one end 4*a* of second plate conductor 4.

Particularly, the electric field of central portion 50 in which first plate conductor 3 and second plate conductor 4 are close to each other is a combination of an end portion electric field, and occurs between gap 5.

The electric field in an oblique transverse direction occurs in central portion 50, but it is possible to neglect the electric field because it is very small.

In addition, the electric field also occurs from end portions 51 and 52 of sides opposite to sides in which first plate conductor 3 and second plate conductor 4 are opposed to each other, but it is also possible to neglect the electric field because it is very small.

The electric field of radio wave radiated from antenna device 1A becomes the circularly polarized wave by end portion electric field (vertical electric field mode M2) occurs between gap 5 of first plate conductor 3 and second plate conductor 4 and by end portion electric field (horizontal electric field mode M1) occurred in each of the other end 3*b* that is opened of first plate conductor 3 and the other end 4*b* that is opened of second plate conductor 4.

Arrow 70 illustrated in FIG. 3 indicates the electric length of first plate conductor 3, or arrow 71 illustrated in FIG. 3 indicates the electric length of second plate conductor 4.

Figure 4B:
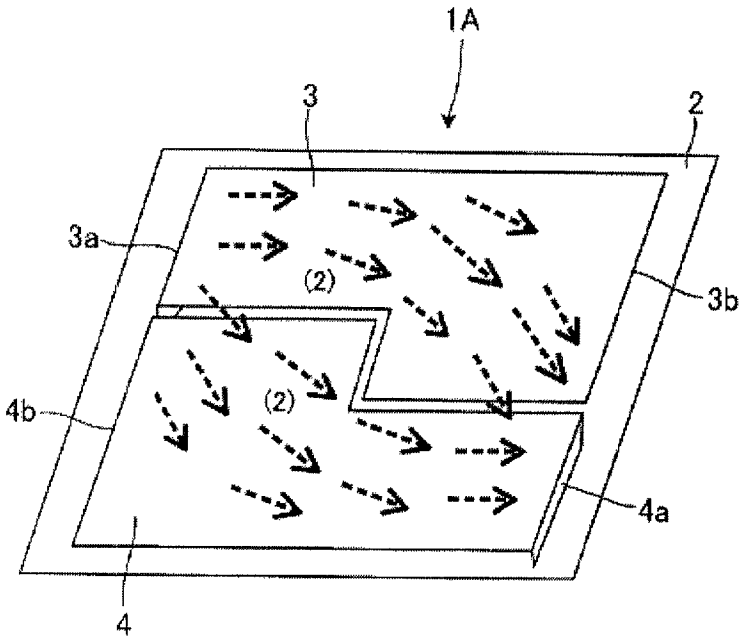
FIG. 4B is a diagram illustrating a current path in the antenna device in FIG. 1.
Figure 4A:
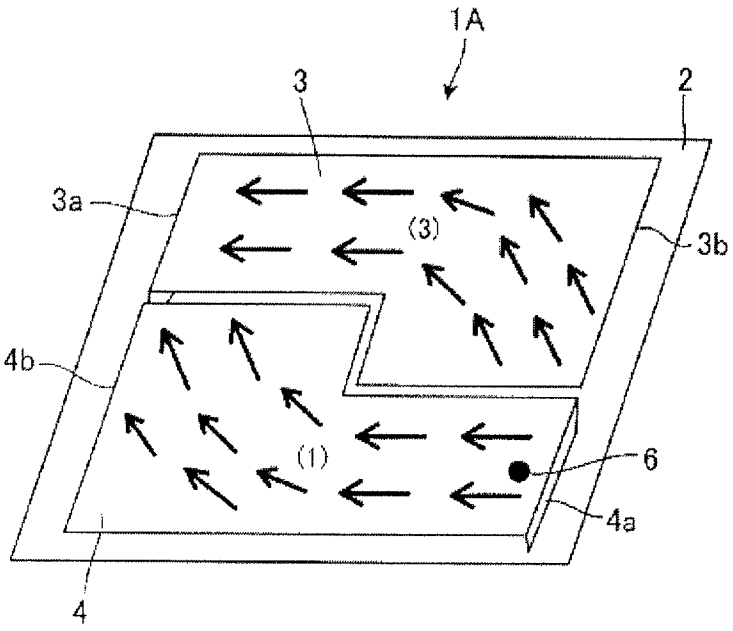
FIG. 4A is a diagram illustrating a current path in the antenna device in FIG. 1.

FIG. 4A and FIG. 4B are diagrams illustrating a current path in antenna device 1A according to the present embodiment.

The arrow illustrated in the figure indicates a flow of a current.

In this case, arrows indicated by solid lines indicate flows on first plate conductor 3 and second plate conductor 4, and arrows indicated by dotted lines indicate flows on GND conductor plate 2.

As illustrated in FIG. 4A, when the electric power is supplied from the vicinity of the short-circuited end of second plate conductor 4, the current from power supplying point 6 flows toward an open end (other end 4*b*) side on second plate conductor 4.

As illustrated in FIG. 4B, since a current phase is changed, the current flows from an open end side of second plate conductor 4 to the short-circuited end (one end 4*a*) side on GND conductor plate 2.

As illustrated in FIG. 4A, when reaching the short-circuited end of second plate conductor 4, the current flows from an open end (other end 3*b*) side thereof to the short-circuited end (one end 3*a*) side on first plate conductor 3.

As described above, the electric power is supplied from the vicinity of the short-circuited end of second plate conductor 4, the current flows on three paths (1) to (3) of current paths on second plate conductor 4 (1)->a current path on GND conductor plate 2 (2)->a current path on first plate conductor 3 (3).

Since the total of these paths (1) to (3) is almost equal to the electric length of the approximately ½ wavelength of the frequency to be used, the total can be used as an antenna of circularly polarized wave characteristics of the approximately ½ wavelength.

In addition, by arranging the first and second plate conductors 3 and 4 on the same plane surface, it is possible to achieve miniaturization to be used for a small communication terminal such as an RFID tag, or by implementing the antenna of the approximately ½ wavelength, it is possible to achieve high sensitivity.

Furthermore, since the GND conductor plate and the first and second plate conductors 3 and 4 have a simple structure, it is possible to easily create them.

Figure 5:
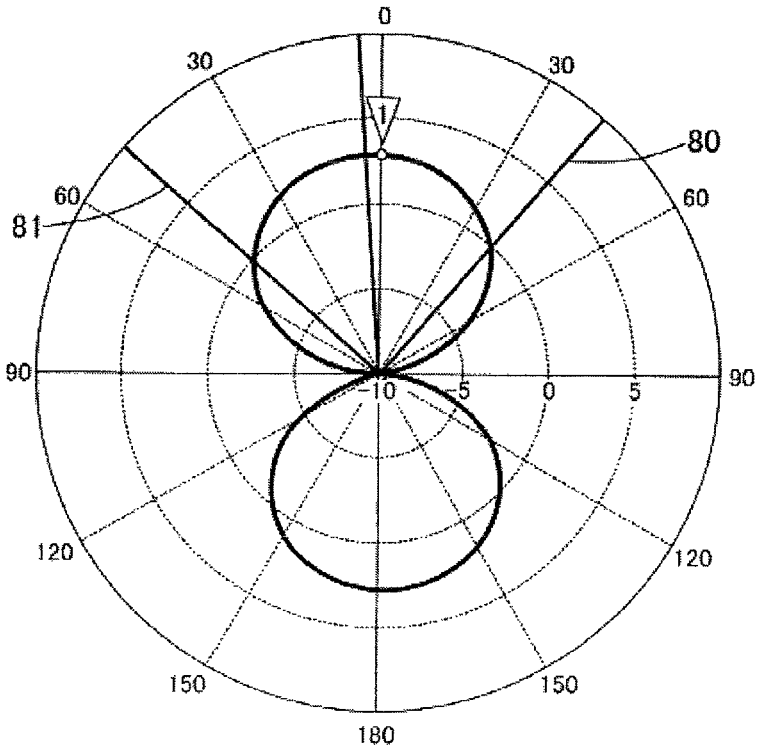
FIG. 5 is a diagram illustrating antenna characteristics in the antenna device in FIG. 1.

FIG. 5 is a diagram illustrating antenna characteristics of antenna device 1A according to the present embodiment.

As illustrated in this figure, an eight-character radiation pattern is obtained, and maximum 2.9 (dBic) is obtained as a circularly polarized wave gain (dBic).

A range indicated by solid lines 80 and 81 is a half value width.

In a case where antenna device 1A according to the present embodiment is used in the RFID tag, the frequency to be used is 920 MHz.

In addition, angle ANG1 (see FIG. 1) in first plate conductor 3 and angle ANG2 (see FIG. 1) in second plate conductor 4 may not be a right angle.

As described above, since a configuration is adopted in which antenna device 1A according to the present embodiment includes flat plate GND conductor plate 2, first plate conductor 3, and second plate conductor 4, first plate conductor 3 is disposed approximately in parallel to GND conductor plate 2, of which one end 3*a* is short-circuited to GND conductor plate 2, and of which the other end 3*b* is opened, second plate conductor 4 is formed with approximately the same shape as that of first plate conductor 3, of which one end 4*a* on a side opposite to first plate conductor 3 is short-circuited, of which the other end 4*b* is opened, a series of physical lengths from the other end 3*b* of first plate conductor 3 to the other end 4*b* of second plate conductor 4, through one end 3*a* of first plate conductor 3, a position on GND conductor plate 2 on which first plate conductor 3 is grounded, a position on GND conductor plate 2 on which second plate conductor 4 is grounded, and one end 4*a* of second plate conductor 4 disposed approximately in parallel to GND conductor plate 2, while providing gap 5 with approximately equal intervals between sides adjacent to first plate conductor 3, are almost equal to the electric length of the approximately ½ wavelength of the frequency to be used, and the electric power is supplied from the vicinity of the short-circuited end (one end 4*a*) of second plate conductor 4, it is possible to obtain the antenna device which has the circularly polarized wave characteristics and high sensitivity and in which the miniaturization which can also be used for the small communication terminal such as the RFID tag is achieved, and it is possible to obtain the antenna device which can be easily created.

The disclosure described in the above-described Japanese Patent No. 5636930 is obviously different from the configuration of the present disclosure in that two power supplying points are provided and they are in opposite phases to each other.

In addition, the above-described Japanese Patent Unexamined Publication No. 2005-079970 is obviously different from the configuration of the present disclosure in that the GND short-circuited position is on the same side surface.

In antenna device 1A according to the present embodiment, as a form in which first plate conductor 3 is short-circuited to GND conductor plate 2, an end portion of first plate conductor 3 is bent at the right angle in a longitudinal direction such that the tip end thereof is connected. However, an extended portion in which the end portion of first plate conductor 3 is bent at the right angle in a width direction is provided such that the tip end may be connected.

An example thereof will be described below.

Figure 6:
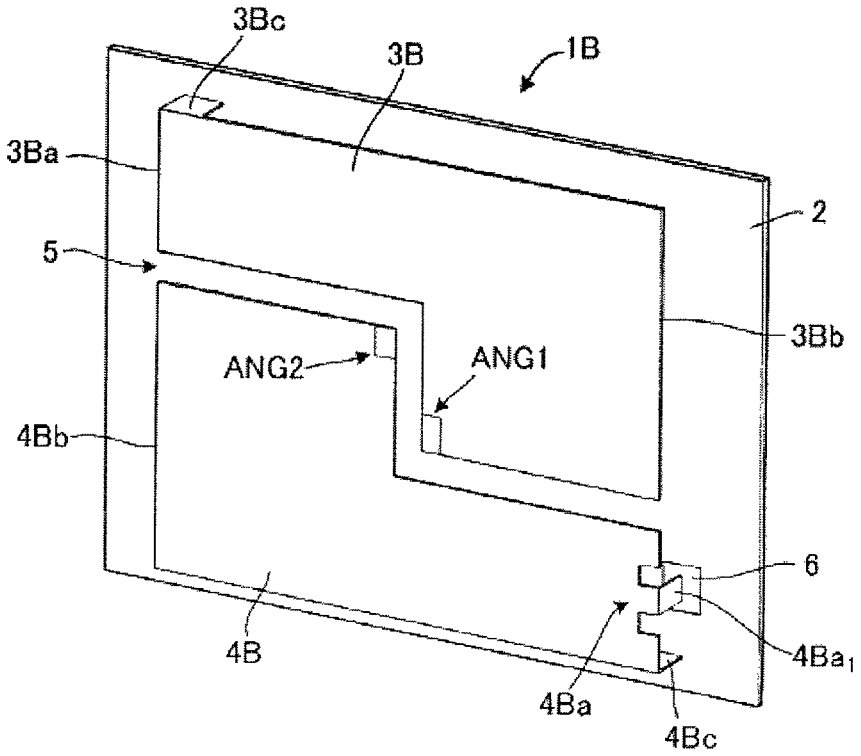
FIG. 6 is a perspective view illustrating a schematic configuration of a first modification example of the antenna device in FIG. 1.

FIG. 6 is a perspective view illustrating a schematic configuration of antenna device 1B that is a first modification example of the above-described antenna device 1A.

The same reference numerals are assigned to members in common with FIG. 1 described above in the same figure, and description thereof is omitted.

First Modification Example

As illustrated in FIG. 6, antenna device 1B of the first modification example has projection piece 3Bc projected in the width direction at a side surface side of one end 3Ba of first plate conductor 3B, or has projection piece 4Bc projected at a side surface side opposite to a side surface of first plate conductor 3B of one end 4Ba of second plate conductor 4B.

Projection piece 3Bc of first plate conductor 3B is bent at the right angle in the longitudinal direction of first plate conductor 3B.

Projection piece 4Bc of second plate conductor 4B is bent at the right angle in the longitudinal direction of second plate conductor 4B similar to projection piece 3Bc of first plate conductor 3B.

Power supplying in antenna device 1B of the first modification example is performed from the vicinity of the short-circuited end of second plate conductor 4B.

Projection piece 4$Ba_1$ for supplying the electric power other than projection piece 4Bc is provided in one end 4Ba of second plate conductor 4B.

This projection piece 4$Ba_1$ is connected to power supplying point 6 provided on GND conductor plate 2.

First plate conductor 3B has projection piece 3Bc on one side surface side. However, first plate conductor 3B may also have the same projection piece on the other side surface side.

In addition, second plate conductor 4B also has projection piece 4Bc on one side surface side. However, second plate conductor 4B may also have the same projection piece on the other side surface side.

Even short-circuiting with respect to GND conductor plate 2 of first plate conductor 3B and short-circuiting with respect to GND conductor plate 2 of second plate conductor 4B in antenna device 1B of the first modification example are performed on a side surface of each end portion, the same effect as that of the above-described antenna device 1A is obtained.

In addition, angle ANG1 in first plate conductor 3B and angle ANG2 in second plate conductor 4B may not be the right angle similar to the above-described antenna device 1A.

Figure 7:
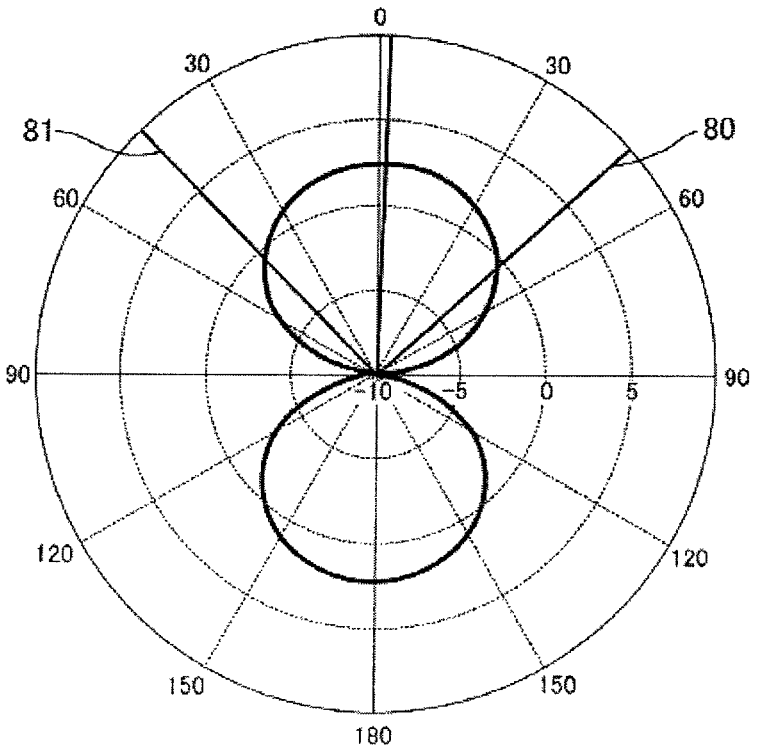
FIG. 7 is a diagram illustrating antenna characteristics of the first modification example of FIG. 6.

FIG. 7 is a diagram illustrating the antenna characteristics of antenna device 1B of the first modification example.

As illustrated in this figure, a radiation pattern is the eight-character shaped radiation pattern, and maximum 2.9 (dBic) is obtained as the maximum circular polarization gain (dBic).

Second Modification Example

Next, the second modification example of the above-described antenna device 1A will be described.

Figure 8:
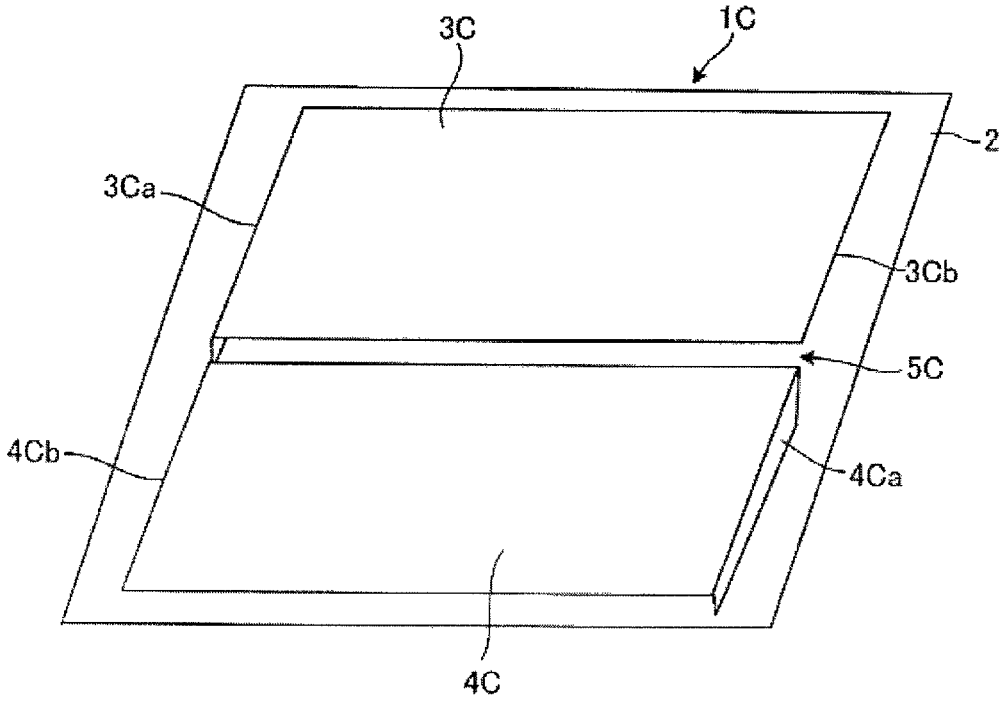
FIG. 8 is a perspective view illustrating a schematic configuration of a second modification example of the antenna device in FIG. 1.

FIG. 8 is a perspective view illustrating a schematic configuration of antenna device 1C that is the second modification example of antenna device 1A.

The same reference numerals are assigned to members in common with FIG. 1 described above in the same figure, and description thereof is omitted.

As illustrated in FIG. 8, each of antenna device 1C, first plate conductor 3C, and second plate conductor 4C of the second modification example has an approximately rectangular flat plate.

First plate conductor 3C is disposed approximately in parallel to GND conductor plate 2.

One end 3Ca of first plate conductor 3C is short-circuited to a ground pattern (not shown) of GND conductor plate 2 and the other end 3Cb is opened.

Second plate conductor 4C is disposed approximately in parallel to the same plane as first plate conductor 3C and to GND conductor plate 2.

One end 4Ca opposite to first plate conductor 3C of second plate conductor 4C is short-circuited to the ground pattern (not shown) of GND conductor plate 2 and the other end 4Cb is opened.

A shape of gap 5C between first plate conductor 3C and second plate conductor 4C is a straight line shape.

Power supplying in antenna device 1C of the second modification example is performed from the vicinity of the short-circuited end of one of first plate conductor 3C and second plate conductor 4C.

For example, in a case where the electric power is supplied from a second plate conductor 4C side, a shape of one end 4Ca of second plate conductor 4C is the same shape as that of one end 4*a* illustrated in FIG. 1 or the same shape as that of one end 4Ba illustrated in FIG. 6.

A series of lengths from the other end 3Cb that is an open end of first plate conductor 3C to the other end 4Cb that is an open end of second plate conductor 4C through one end 3Ca of first plate conductor 3C that is grounded, a position on GND conductor plate 2 on which first plate conductor 3C is grounded, a position on GND conductor plate 2 on which second plate conductor 4C is grounded, and one end 4Ca of second plate conductor 4C that is grounded, are almost equal to the electric length of the approximately ½ wavelength of the frequency to be used.

Antenna device 1C according to the second modification example having such a configuration also obtains the same effect as that of the above-described antenna device 1A.

Third Modification Example

Next, a third modification example of the above-described antenna device 1A will be described.

Figure 9:
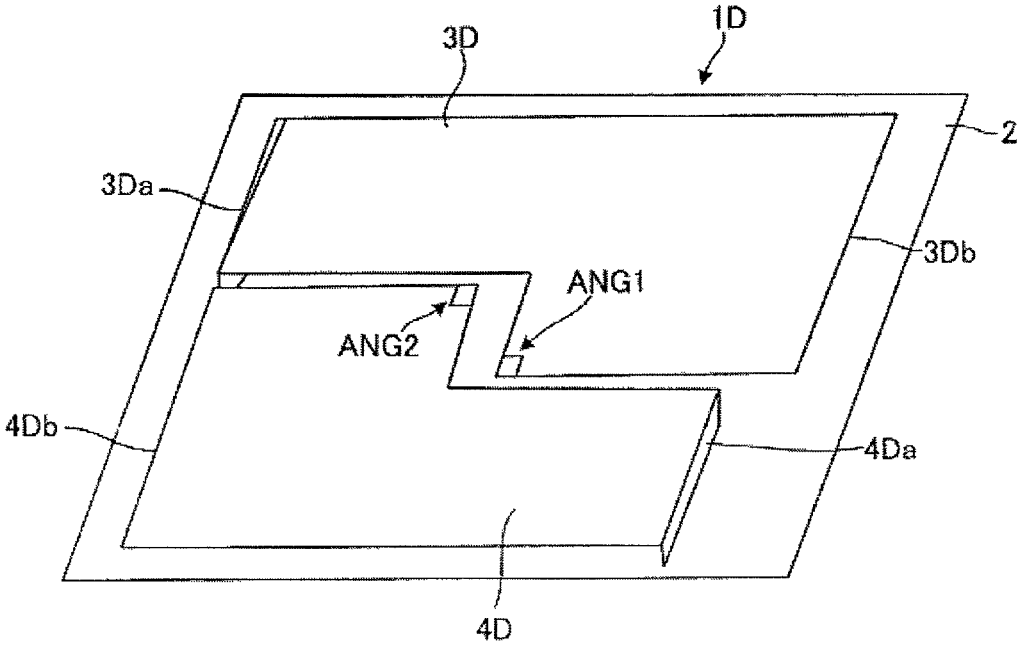
FIG. 9 is a perspective view illustrating a schematic configuration of a third modification example of the antenna device in FIG. 1.

FIG. 9 is a perspective view illustrating a schematic configuration of antenna device 1D that is the third modification example of antenna device 1A.

The same reference numerals are assigned to members in common with FIG. 1 described above in the same figure, and description thereof is omitted.

As illustrated in FIG. 9, unlike the above-described antenna device 1A, first plate conductor 3D and second plate conductor 4D are not a point symmetry with respect to antenna device 1D of the third modification example and second plate conductor 4D is shorter than first plate conductor 3D.

Other than this point, antenna device 1D has the same structure as antenna device 1A.

In addition, similar to antenna device 1C of the second modification example, the electric power is supplied from the vicinity of the short-circuited end one of first plate conductor 3D and second plate conductor 4D.

For example, in a case where the electric power is supplied from a second plate conductor 4D side, one end 4Da of second plate conductor 4D is the same shape as that of one end 4*a* illustrated in FIG. 1 or the same shape as that of one end 4Ba illustrated in FIG. 6.

The series of lengths from the other end 3Db that is an open end of first plate conductor 3D to the other end 4Db that is an open end of second plate conductor 4D, through one end 3Da of first plate conductor 3D that is grounded, a position on GND conductor plate 2 on which first plate conductor 3D is grounded, a position on GND conductor plate 2 on which second plate conductor 4D is grounded, and one end 4Da of second plate conductor 4D that is grounded are almost equal to the electric length of the approximately ½ wavelength of the frequency to be used.

Angle ANG1 in first plate conductor 3D and angle ANG2 in second plate conductor 4D may also not be the right angle similar to the above-described antenna device 1A.

Even in antenna device 1D of the third modification example of such a configuration, the same effect as the above-described antenna device 1A is obtained.

Figure 10:
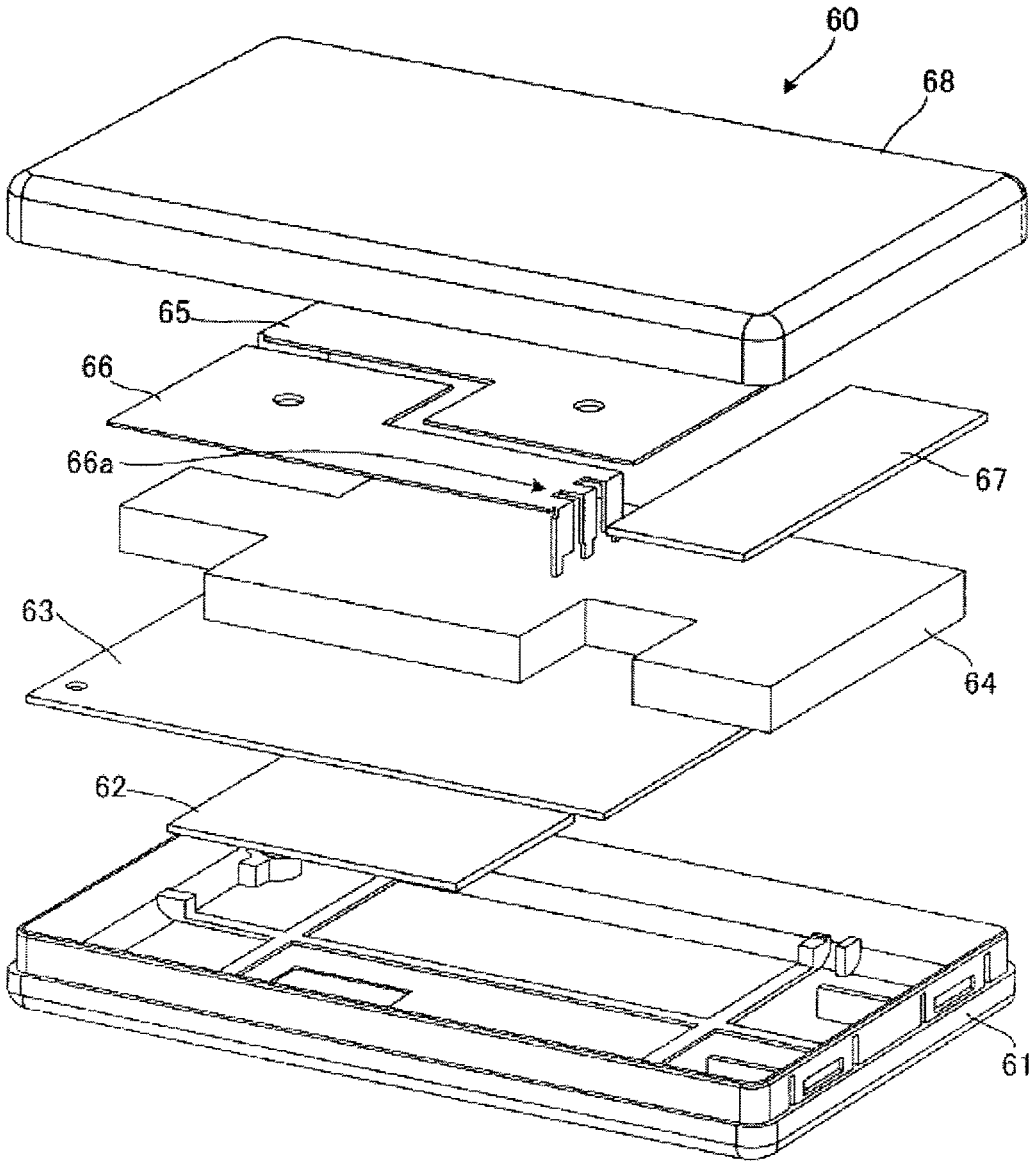
FIG. 10 is an exploded view illustrating an application terminal of an RFID tag using the antenna device in FIG. 1.

FIG. 10 is an exploded view illustrating an application terminal of the RFID tag using antenna device 1A in FIG. 1.

Application terminal 60 of the RFID tag illustrated in this figure includes housing case 61, circuit substrate 62, EH (energy harvest) antenna ground plate (corresponding to GND conductor plate 2) 63, cushion member 64, EH antennas 65 and 66 (corresponding to first plate conductor 3 and second plate conductor 4), RFID communication antenna 67, and housing cover 68.

For example, housing case 61 and housing cover 68 are configured with synthetic resin and ABS resin.

For example, cushion member 64 is configured with a foam material.

For example, a print pattern by copper foil or nickel silver is used in RFID communication antenna 67.

One end 66*a* of EH antenna 66 corresponding to second plate conductor 4 is formed with three branch portions, the central branch portion is connected to the power supplying point (not shown) provided on EH antenna ground plate 63 corresponding to GND conductor plate 2, and branch portions of both sides are short-circuited to a ground pattern (not shown) of EH antenna ground plate 63.

The power supplying point (not shown) provided on EH antenna ground plate 63 is connected to an RF output terminal (not shown) on circuit substrate 62 by a wire.

Since this application terminal 60 uses antenna device 1A, application terminal 60 has the circularly polarized wave characteristics and high sensitivity such that it is possible to achieve miniaturization and easily create the application terminal.

Antenna device 1B of FIG. 6, antenna device 1C of FIG. 8, and antenna device 1D of FIG. 9 other than the antenna device LA in FIG. 1 can be used in present application terminal 60.

So far, although one embodiment of the present disclosure and its modification examples (first to third) have been described in detail, It will be apparent to those skilled in the art that various changes and modifications can be made without departing from the spirit and scope of the present disclosure.

The antenna device according to the present disclosure can be applied to the small communication terminal, energy harvest, and the like such as the tag of the RFID.

What is claimed is:

1. An antenna device comprising:

a flat plate GND conductor plate;

a first plate conductor that is disposed approximately in parallel to the GND conductor plate, and of which one end is grounded to the GND conductor plate, and the other end that is opposed to the one end is opened; and a second plate conductor that has approximately the same shape as that of the first plate conductor, of which one end is grounded to the GND conductor plate, of which the other end that is opposed to the one end is opened, that is disposed at a position obtained by rotating the first plate conductor approximately 180 degrees about an intersection line passing through an approximately central point of the GND conductor plate as an axis on the same plane as the first plate conductor on the GND conductor plate, and that has a ground portion at which the grounding is performed and an open portion at which the opening is performed at positions obtained by rotating the ground portion and the open portion of the first plate conductor approximately 180 degrees about the axis, wherein the first plate conductor and the second plate conductor have a gap with approximately equal intervals between sides adjacent to each other, the gap is formed by a side other than the one end and the other end on a surface of the first plate conductor approximately in parallel to the GND conductor plate and a side other than the one end and the other end on a surface of the second plate conductor approximately in parallel to the GND conductor plate, a series of lengths from the other end that is an open end of the first plate conductor to the other end that is an open end of the second plate conductor, through the one end of the first plate conductor that is grounded, a position on the GND conductor plate on which the first plate conductor is grounded, a position on the GND conductor plate on which the second plate conductor is grounded, and the one end of the second plate conductor that is grounded, are almost equal to an electric length of approximately ½ wavelength of a frequency to be used, electric power is supplied from any one of the first plate conductor and the second plate conductor, and circularly polarized wave is radiated from a surface of the GND conductor plate not including the first plate conductor and the second plate conductor to a surface of the GND conductor plate including the first plate conductor and the second plate conductor.

2. The antenna device of claim 1, wherein a distance from the ground portion of the first plate conductor to an edge of the GND conductor plate near the ground portion of the first plate conductor and a distance from the ground portion of the second plate conductor that is positioned at a rotationally symmetric position by the axis with respect to the ground portion of the first plate conductor to the edge of the GND conductor plate near the ground portion of the second plate conductor are almost equal to each other.

3. The antenna device of claim 1, wherein each of the first plate conductor and the second plate conductor has a plane shape of an approximately L shape.

4. The antenna device of claim 1, wherein each of the first plate conductor and the second plate conductor has a plane shape of an approximately rectangular shape.

* * * * *